United States Patent [19]

Boldrin et al.

[11] Patent Number: 4,800,798

[45] Date of Patent: Jan. 31, 1989

[54] CONTROL SURFACE DUAL REDUNDANT SERVOMECHANISM

[75] Inventors: Clete M. Boldrin, Renton; Richard D. McCorkle; Jimmy W. Rice, both of Seattle; James J. Rustik, Kent, all of Wash.

[73] Assignee: The United States of America as represented by the Secretary of the Air Force, Washington, D.C.

[21] Appl. No.: 680,674

[22] Filed: Dec. 11, 1984

[51] Int. Cl.[4] ..... F15B 13/16

[52] U.S. Cl. ..... 91/361; 91/384; 244/227; 416/114

[58] Field of Search ..... 91/361, 384; 244/227, 244/17.13, 75 R; 416/114, 162

[56] References Cited

U.S. PATENT DOCUMENTS

| | | | |
|---|---|---|---|
| 3,368,351 | 2/1968 | Wood et al. | 60/97 |
| 3,482,486 | 12/1969 | Nordholm, Jr. | 91/411 |
| 3,640,183 | 2/1972 | Kock et al. | 91/1 |
| 3,968,730 | 7/1976 | Lionet | 91/171 |
| 4,274,808 | 6/1981 | Garner | 416/114 |
| 4,336,745 | 6/1982 | Lund | 91/35 |
| 4,531,448 | 7/1985 | Barnes | 91/384 |

*Primary Examiner*—Donald P. Walsh

*Attorney, Agent, or Firm*—Bobby D. Scearce; Donald J. Singer

[57] ABSTRACT

A dual redundant servomechanism for moving aircraft control surfaces is disclosed. The servomechanism is of the type whose input commands, from the pilot of the aircraft, are transmitted electrically. Force fight, which is associated with such dual servomechanisms when they are connected to a common aircraft control surface, is minimized. This is accomplished by providing the control system for each servomechanism with input signals which are electrically summed. Each control system includes electrical transducers which provide a signal indicative of actuator position and the pressure associated with the hydraulic motor used in each servomechanism.

3 Claims, 2 Drawing Sheets

CONTROL SURFACE DUAL REDUNDANT SERVOMECHANISM

RIGHTS OF THE GOVERNMENT

The invention described herein may be manufactured and used by or for the Government of the United States for all governmental purposes without the payment of any royalty.

BACKGROUND OF THE INVENTION

This invention relates generally to aircraft control systems. The invention, in particular, relates to control systems wherein the actuators of such systems, are hydraulically driven and wherein command signals from the aircraft cockpit to the control surface actuators are transmitted electrically.

For safety reasons, an attempt is made to design aircraft systems with as much redundancy as possible. An effort is generally made to provide redundancy in those areas where a failure would pose a substantial risk to the aircraft and its occupants.

Transmittal of control signals between the aircraft cockpit and the actuator for the aircraft control surface may take many forms. In small light aircraft, the signals from the aircraft pilot are mechanically transmitted to the aircraft's aerodynamic control surfaces such as flaps, elevators, rudder and ailerons. In more sophisticated aircraft the signals are transmitted hydraulically. In some cases, a hydraulic "boost" is provided so that the pilot need not supply all, if any, of the power required to move the applicable control surface.

Certain advanced aircraft have "fly by wire" control systems wherein the signals from the cockpit are transmitted electrically, to hydraulic actuator systems which mechanically move the aircraft's control surfaces.

In such systems, movement of the pilot operable member, e.g. control stick, flap handle, etc., causes movement of a transducer which generates a signal which is proportional to the magnitude of movement of the applicable pilot operable member. Such systems, depending upon their complexity, may also include force transducers, as well as other types of means for generating electrical signals. Redundancy may be provided by having two or more transducers for the same function and by providing multiple parallel electrical circuits for transmitting the signals to the control surface actuator systems.

Aircraft are generally provided with hydraulic or electrical actuators which move the aircraft's control surfaces.

It has also been found desirable to provide redundant actuators for the aircraft's control surfaces so that a failure of an actuator will not result in an inability to move the applicable control surface. Various problems arise when dual actuator redundancy is desired. Two actuators operating on a common member may work against one another if they operate at slightly different speeds or forces. These problems have been solved in some dual actuator systems by having them operate through a common mixing box, or some other such arrangement, so that such differences are mechanically compensated for in the system. These systems generally result in there being, at some point, a single load carrying member between the actuators and the aerodynamic control surface. This single load carrying pathway results in a point where there is no redundancy. This will be the weakest point in the system as the control surface itself, and the hinges associated with it, may also be provided with redundancy. In those applications where dual actuators are connected directly to the control surface the aforesaid problem is not encountered.

In some dual actuator applications, a phenomenon known as "force fight" is encountered. This occurs when the control system for the actuators themselves include position or some other parameter indicative of actuator performance, in a feedback loop in the actuator's control system. In this situation, an actuator which has arrived at its proper position may be moved by the second actuator when it is attempting to arrive at its position. This causes the first actuator to attempt to return to its proper position thereby disturbing the second actuator. This results in the two actuators operating in opposition to one another. It is because of these problems the dual rotary actuators have not been connected at opposing ends of a common control surface, particularly in "fly by wire" systems.

SUMMARY OF THE INVENTION

Accordingly, it is an object of the present invention to provide a redundant dual actuator control system for an aircraft in which force fight is eliminated.

It is a further object of the present invention to provide a dual actuator system for an aircraft aerodynamic control surface to which the actuators are connected, in parallel, to the control surface.

It is a further object of the present invention to provide an actuator system in accordance with the prior objects wherein commands are transmitted electrically from the aircraft cockpit to the actuator systems.

The present invention includes dual actuator systems: each of which includes an actuator assembly. The actuator assembly, which provides the force to move the control surface, a high speed, low torque, hydraulic motor. The rotary motor draws a low speed, high torque rotary actuator. Each actuator is connected through a set of linkages to opposing ends of an aircraft control surface, such as a flap. The two rotary actuators are connected to one another by a common shaft so that a failure in one system will permit the surviving system to drive both ends of the control surface.

Each system is provided with a position sensing transducer and a pressure transducer which provides a signal indicative of the hydraulic pressure which drives the hydraulic motor. The transducer signals are incorporated in a feedback loop within each system and are additionally fed to the other control system. In this manner, the input signals to the actuator systems are electrically summed and any force fight or position error causes each actuator system to adjust itself to minimize the force fight and seek an average position.

BRIEF DESCRIPTION OF THE DRAWINGS

The construction of the preferred embodiment as well as further objects and advantages of the invention will become further apparent from the following specification when considered with the accompanying drawings in which like numerals refer to like parts and wherein.

DESCRIPTION OF THE PREFERRED EMBODIMENT

Figure 1:
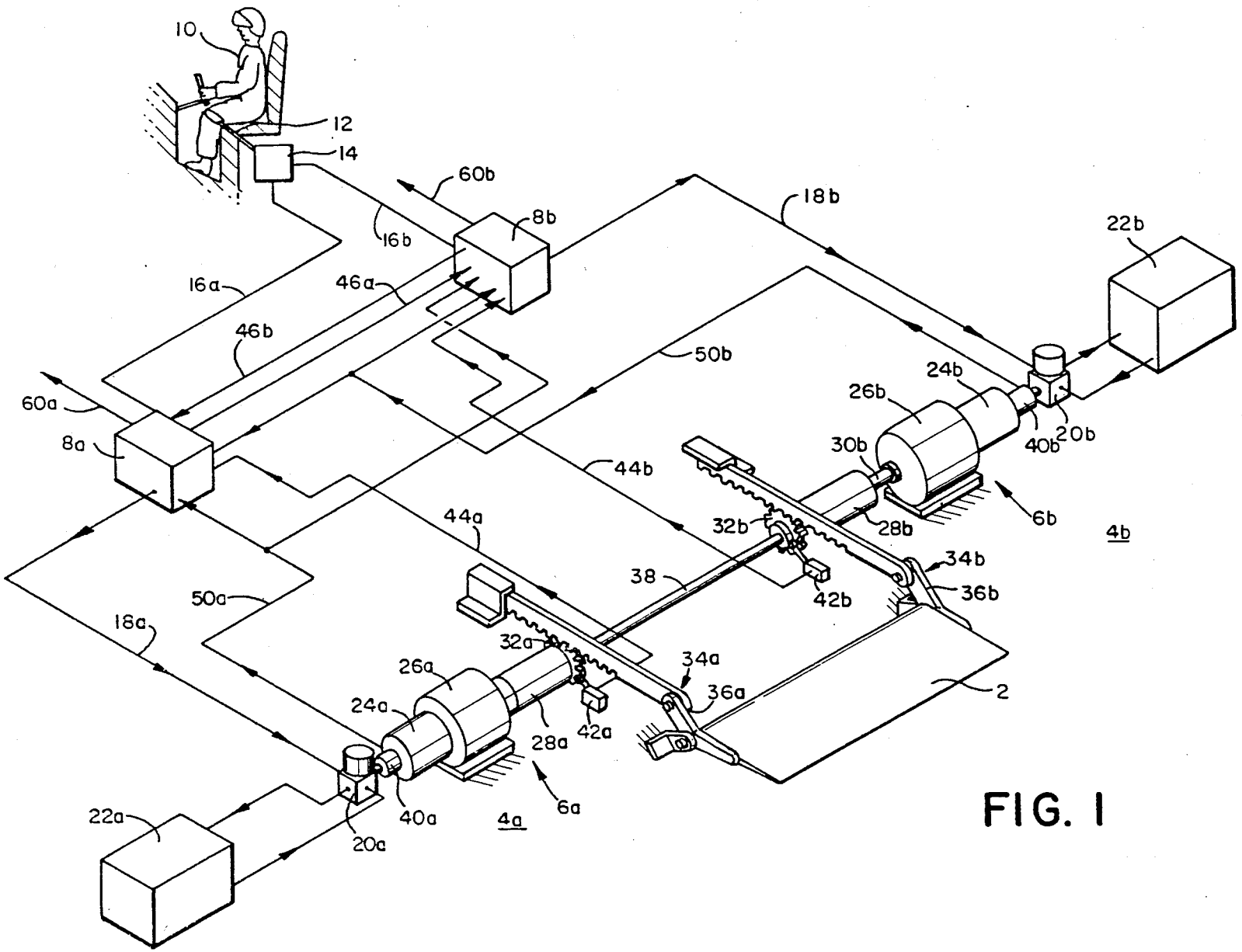
FIG. 1 is a schematic diagram showing the present invention.

Reference will now be made to FIG. 1. An aircraft flap 2 is shown connected to a pair of dual actuator systems 4a and 4b. Actuator systems 4a and 4b include an actuator assembly 6 and a control system 8 designated a and b respectively.

In operation, a pilot 10 moves a flap handle 12 which in turn moves a transducer 14. The transducer 14 sends an electrical command signal 16a and 16b to control systems 8a and 8b, respectively. Although one transducer 14 is shown generating signals 16a and 16b, a separate transducer for each signal could be used for further redundancy. Additionally, in actual implementation of the present invention, redundant control systems for control systems 8a and 8b may be provided.

An output or a command signal 18a and 18b is sent from control systems 8a and 8b, respectively to actuator assemblies 6a and 6b which will in turn drive flap 2.

Each of actuator assemblies 6a and 6b include a servovalve 20 which permits pressurized hydraulic fluid from a reservoir 22 to drive a hydraulic motor 24. The hydraulic motor 24 drives a gear box 26 which in turn drives actuator 28 via shaft 30. Actuator 28 has a output gear 32. The output gear of the actuator assembly engages a link 34 which moves a bracket 36, which is in turn connected to the flap 2. Although the actuators 28 are connected to the opposing ends of flap 2 it is to be understood that such brackets or connecting points to the flap may be positioned in board of the flap's opposing ends without departing from the spirit of the invention.

A shaft 38 is shown connected to the output gear 32 of the actuator assemblies 6. The purpose of shaft 38 is to permit one of the actuator systems 4 to drive both ends of the flap in the event the other actuator system 4 becomes inoperable.

Each of the actuator systems 4 include a pressure transducer which provides a signal indicative of the pressure driving the hydraulic motor 24. It detects the difference between the pressure in the hydraulic input and hydraulic output lines to the hydraulic motor. Each of the actuator systems 4 also include a position transducer 42 which is connected to the output gear of actuator 28 and which generates a signal indicative of the position of the actuator.

Figure 2:
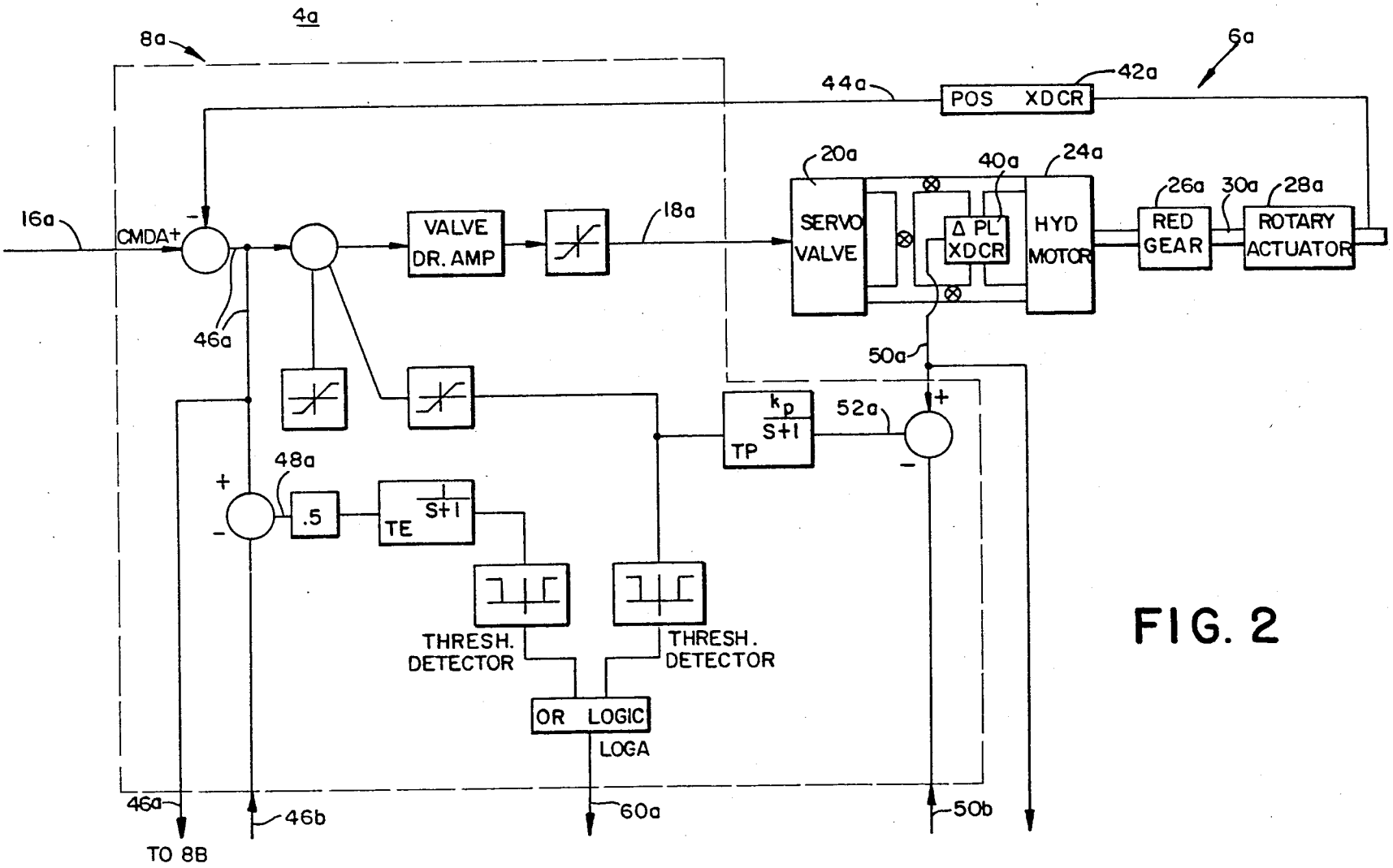
FIG. 2 is a block diagram of the control system for one of the actuator systems shown in FIGS. 1 and 2.

Reference will now be made to FIG. 2 in addition to FIG. 1 where the actuator system 4a including its control system 8a and actuator assembly 6a are shown in block diagram form. An output signal 44a is generated by the position transponder 42a. A signal 46a is generated which is indicative of the difference between command signal 16a and position transponder signal 44a. 46a is transmitted to control system 8b. Signal 46a is also algebraically summed with an equivalent signal 46b received from control system 8b. A signal 48a is generated which is indicative of the difference between signals 46a and 46b. Signal 48a is processed and is fed back into the path leading to the servovalve 20a.

The processing utilized in the preferred embodiment is defined by the system transfer functions indicated in the block diagram of FIG. 2. The different signal 48a is directed to the amplifier with a gain of 0.5 as shown. The output of the amplifier is introduced into a filter with characteristics and transfer function as indicated in FIG. 2. The output of this filter as shown is fed back through a limiting device and into the path leading to servovalve 20a as shown and described earlier. The output of said filter device is also fed to a threshold detector as will be described below. Those skilled in the art will appreciate the design and uses of the filtering and limiting mechanism shown in the block diagram of FIG. 2. Transfer functions indicated thereon can be calculated and changed as appropriate for the particular design of the mechanical elements utilized in practicing the invention, and will be obvious to those skilled in the art of both electronics and control system dynamics.

A signal 50a is produced by pressure transducer 40a. A signal 52a indicative of the difference between signal 50a and its equivalent signal 50b from control system 8b is also processed and passed through the control system to become part of signal 18a to the servovalve. Processing of the signal 52a consists of a filter with a transfer function as indicated in the appropriate block diagram of FIG. 2. The filtered signal is limited and added back into the signal chain as indicated in FIG. 2, to ultimately become part of the signal 18a controlling servovalve 20a. Signal 50a from the pressure transducer is also transmitted to control system 8b where it is used in a manner identical to the way in which signal 50b is used in control system 8a, as shown.

A signal 60a is provided which is indicative of a system failure. This signal may be used to activate redundant control systems and to provide an indication to the pilot that there has been such a failure. As shown in FIG. 2, the outputs of the two filters as described above, are directed to similar threshold detectors, the output of which is directed to or logic. Should the outputs of either of the filters deviate substantially from the output of the other, the or logic will be activated and failure signal 60a will appear.

By using the signals generated by the position and pressure transducers each actuator system is caused to adjust itself to minimize force fight and to seek an average position.

It will be appreciated that the description above of the feedback and control system describes one-half of the actual systems used in the entire invention. The redundant actuator system 4b, including its control system 8b, and other associated components shown in FIG. 1 will function in a similar fashion as described above for one-half the system.

What is claimed is:

1. In an aircraft having a pilot operable member and an aerodynamic control surface which moves in response to movement of the pilot operable member a dual servomechanism assembly which comprises:

a displacement transducer connected to the pilot operable member for generating substantially identical first and second command signals which are proportional to the displacement of the pilot operable member;

first and second hydraulic actuators having respective first and second output members operatively connected to said control surface so as to cause movement thereof in response to movement of said actuators, said first and second hydraulic actuators being operatively interconnected whereby one of said first and second actuators drives the other upon said other becoming inoperative;

first and second control systems operatively interconnecting respective first and second hydraulic actuator assemblies and said displacement transducer and responsive to respective said first and second command signals for generating respective first and second control signals for controlling respective said first and second hydraulic actuators; and sensor means for sensing force fight between said first and second hydraulic actuators, said sensor means including first and second transducer means operatively interconnecting respective said first and second hydraulic actuators and said first and second control systems for generating respective first and second feedback signals indicative of one of respective pressures within said first and second hydraulic actuators and respective positions of said first and second output members, said first feedback signal received by said first control system and said second feedback signal received by said second control system.

2. The dual servomechanism of claim 1 wherein said first and second control systems generate respective first and second command/feedback signals indicative respectively of said first command signal less said first feedback signal and said second command signal less said second feedback signal, and wherein said first control system receives said second command/feedback signal and said second control system receives said first command/feedback signal.

3. The dual servomechanism of claim 2 wherein said sensor means further includes third and fourth transducer means operatively interconnecting respective said first and second hydraulic actuators and said first and second control systems for generating respective third and fourth feedback signals indicative of the other of respective pressures within said first and second hydraulic actuators and respective positions of said first and second output members, and wherein said third feedback signal is received by said first control system and said fourth feedback signal is received by said second control system.

* * * * *